US011837202B2

(12) United States Patent
Kebrle

(10) Patent No.: US 11,837,202 B2
(45) Date of Patent: Dec. 5, 2023

(54) TORSIONAL BASED TREMOLO SYSTEM WITH A MOVING BRIDGE

(71) Applicant: John Michael Kebrle, Dallas, TX (US)

(72) Inventor: John Michael Kebrle, Dallas, TX (US)

( * ) Notice: Subject to any disclaimer, the term of this patent is extended or adjusted under 35 U.S.C. 154(b) by 0 days.

(21) Appl. No.: 17/591,871

(22) Filed: Feb. 3, 2022

(65) Prior Publication Data

US 2022/0230605 A1 Jul. 21, 2022

Related U.S. Application Data

(63) Continuation of application No. 17/249,402, filed on Mar. 1, 2021, now Pat. No. 11,250,822.

(60) Provisional application No. 62/983,735, filed on Mar. 1, 2020.

(51) Int. Cl.

| | |
|---|---|
| ***G10D 3/12*** | (2020.01) |
| ***G10D 1/08*** | (2006.01) |
| ***G10D 3/153*** | (2020.01) |
| ***G10D 3/04*** | (2020.01) |

(52) U.S. Cl.

CPC ..... *G10D 3/12* (2013.01); *G10D 1/08* (2013.01); *G10D 3/04* (2013.01); *G10D 3/153* (2020.02)

(58) Field of Classification Search

CPC .. G10D 3/12; G10D 1/08; G10D 3/04; G10D 3/153

See application file for complete search history.

(56) References Cited

U.S. PATENT DOCUMENTS

| | | | |
|---|---|---|---|
| 3,241,418 | A | 3/1966 | Fender |
| 3,248,991 | A | 5/1966 | Cole |
| 3,326,072 | A | 6/1967 | Price |
| 3,396,284 | A | 8/1968 | Scherer |
| 3,407,696 | A | 10/1968 | Smith et al. |
| 3,990,341 | A | 11/1976 | Pace, Sr. |
| 4,135,426 | A | 1/1979 | Rickard |
| 4,141,271 | A | 2/1979 | Mullen |
| 4,171,661 | A | 10/1979 | Rose |
| 4,285,262 | A | 8/1981 | Thomas |
| 4,354,417 | A | 10/1982 | Glaser |
| 4,361,068 | A | 11/1982 | Schaller |
| 4,457,201 | A | 7/1984 | Storey |
| 4,497,236 | A | 2/1985 | Rose |
| 4,516,462 | A | 5/1985 | Schulze |
| 4,517,874 | A | 5/1985 | Fender |
| 4,549,461 | A | 10/1985 | Rose |

(Continued)

OTHER PUBLICATIONS

Corrected Notice of Allowance, dated Apr. 25, 2023, by the USPTO, re U.S. Appl. No. 17/249,405.

(Continued)

*Primary Examiner* — Kimberly R Lockett

(74) *Attorney, Agent, or Firm* — Law Office of Bill Naifeh

(57) ABSTRACT

Disclosed is a torsion based tremolo apparatus that includes a moving plate rotatably coupled to a mounting plate. A torsion device imparts torsional force to the moving plate relative to the mounting plate around an axis of rotation. The mounting plate is used to attach the tremolo apparatus to a guitar or other string musical instrument. Adjustable bridge clamps and tuning plates coupled to the moving plate may be used to set the tension on the instrument strings as desired. Rotation of the moving plate relative to the mounting plate alters the tension on the instrument strings.

20 Claims, 19 Drawing Sheets

(56) References Cited

U.S. PATENT DOCUMENTS

| | | | | |
|---|---|---|---|---|
| 4,555,970 | A | 12/1985 | Rose | |
| 4,563,934 | A | 1/1986 | Keizer | |
| 4,632,004 | A | 12/1986 | Steinberger | |
| 4,674,389 | A | 6/1987 | Leo | |
| 4,882,967 | A | 11/1989 | Rose | |
| 4,915,006 | A | 4/1990 | Steinberger | |
| 4,955,275 | A | 9/1990 | Gunn | |
| 4,967,631 | A | 11/1990 | Rose | |
| 4,993,300 | A | 2/1991 | Ejen | |
| 5,046,393 | A | 9/1991 | Xenidis | |
| 5,497,690 | A | 3/1996 | Soupios | |
| 5,637,818 | A | 6/1997 | Fishman et al. | |
| 5,864,074 | A | 1/1999 | Hill | |
| 7,459,619 | B2 | 12/2008 | Gawenda | |
| 9,847,076 | B1 * | 12/2017 | McCabe | G10D 1/085 |
| 9,959,845 | B2 | 5/2018 | Decker | |
| 11,250,822 | B2 * | 2/2022 | Kebrle | G10D 3/153 |
| 11,437,003 | B2 | 9/2022 | Kebrle | |
| 2007/0169609 | A1 | 7/2007 | Gawenda | |
| 2008/0229900 | A1 | 9/2008 | Steinberger | |
| 2021/0272538 | A1 | 9/2021 | Kebrle | |
| 2022/0343881 | A1 | 10/2022 | Kebrle | |

OTHER PUBLICATIONS

Corrected Notice of Allowance, dated Dec. 14, 2022, by the USPTO, re U.S. Appl. No. 17/249,405.

Notice of Allowance, dated Apr. 13, 2022, by the USPTO, re U.S. Appl. No. 17/249,403.

Notice of Allowance, dated Oct. 4, 2021, by the USTPO, re U.S. Appl. No. 17/249,402.

Notice of Allowance, dated Oct. 5, 2022, by the USPTO, re U.S. Appl. No. 17/249,405.

Office Action, dated Jun. 21, 2022, by the USPTO, re U.S. Appl. No. 17/249,405.

* cited by examiner

TORSIONAL BASED TREMOLO SYSTEM WITH A MOVING BRIDGE

CLAIM OF PRIORITY AND INCORPORATION BY REFERENCE

This application is a continuation of U.S. application Ser. No. 17/249,402, filed Mar. 1, 2021, entitled A TORSIONAL BASED TREMOLO SYSTEM WITH A MOVING BRIDGE, which claims the benefit of U.S. Provisional Application No. 62/983,735, filed on Mar. 1, 2020, and entitled A TORSIONAL BASED TREMOLO SYSTEM AND APPARATUS FOR INCREASING OR DECREASING THE TENSION AND PITCH OF THE STRINGS OF A MUSICAL INSTRUMENT. The disclosures of which are hereby incorporated by reference in their entirety.

TECHNICAL FIELD

The invention relates in general to musical instruments and in particular to an improved tremolo system for string musical instruments.

BRIEF DESCRIPTION OF THE DRAWINGS

For a more complete understanding, reference is now made to the following description taken in conjunction with the accompanying Drawings in which.

DETAILED DESCRIPTION

Figure 1A:
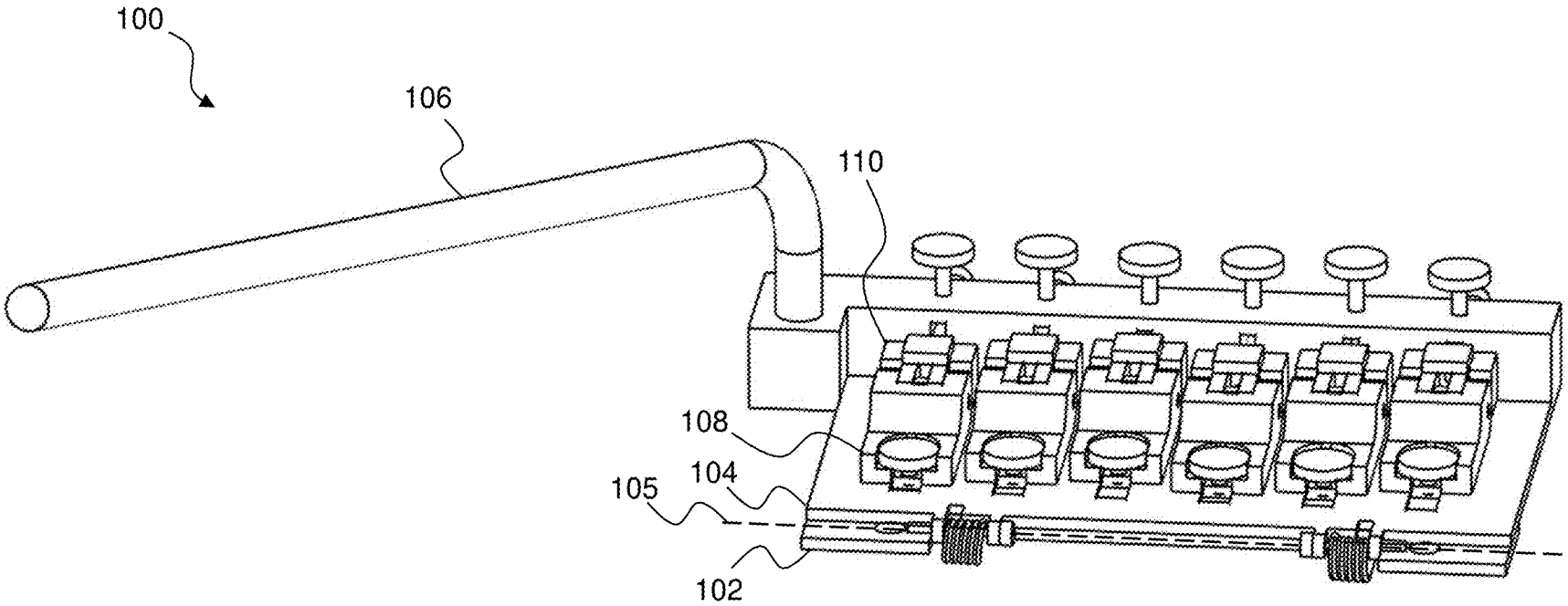
FIGS. 1A-1F illustrate various views of one embodiment of a tremolo apparatus.

Specific examples of components and component arrangements are described below to simplify the present disclosure. These are, of course, merely examples and are not intended to limit the invention from that described in the claims. Well-known elements may be presented without detailed description in order not to obscure the present invention in unnecessary detail. For the most part, details unnecessary to obtain a complete understanding of the present invention have been omitted inasmuch as such details are within the skills of persons of ordinary skill in the relevant art.

When directions, such as upper, lower, top, bottom, clockwise, counterclockwise, are discussed in this disclosure, such directions are meant to only supply reference directions for the illustrated figures and for orientation of components in the figures unless specifically stated otherwise. The directions should not be read to imply actual directions used in any resulting invention or actual use. Under no circumstances should such directions be read to limit or impart any meaning into the claims.

Referring to FIGS. 1A-1F, one embodiment of a tremolo apparatus 100 is illustrated from different viewing angles. The tremolo apparatus 100 is configured to be attachable to a string musical instrument without requiring modification of the instrument. For example, the tremolo apparatus 100 may be surface mounted using existing mounting holes intended for a guitar's bridge. It is understood, however, that in other embodiments modifications may be made to the musical instrument prior to mounting the tremolo assembly 100.

For purposes of example, the tremolo apparatus 100 is described with respect to its use with a guitar and the figures generally illustrate the tremolo apparatus as configured to interact with six separate strings of the instrument. However, for other numbers of strings, additional components may be added or removed, or some illustrated components may remain unused if not needed.

The tremolo apparatus 100 operates as a torsion device, rather than a tension or compression device, in order to simultaneously decrease or increase the tension on all of the strings of a musical instrument. In operation, this is accomplished by moving a portion of the tremolo apparatus 100 from a first position to a second position in either an upward or downward motion. This, in turn, increases or decreases the tension of the musical instrument's strings. Generally, the tremolo apparatus 100 uses torsion about an axis as a means of regulating and modulating the tension of the strings, rather than using tension or compression springs to generate a moment about the axis to counteract the tension and modulate the tension of the strings.

Many tremolos require significant modification of the musical instrument, generally being mounted into a cavity on the bottom side of the tremolo and often requiring cavities on both the front and back of the instrument. These modifications are generally undesirable for a number of reasons, including, but not limited to, significant alterations affect the tonal qualities of the instrument and increase manufacturing costs of the instrument in that creating these cavities cost time and money, and may require significant adjustment.

The design of the tremolo apparatus 100 generally enables a surface mount and does not require significant modification of the instrument, permanent modification of the instrument, or removal of material from the instrument in the form of a cavity. Accordingly, the tonal qualities of the instrument are generally not altered when using the tremolo apparatus 100.

With specific reference to FIG. 1A, the tremolo apparatus 100 includes a mounting plate 102 that is rotatably coupled to a moving plate 104. The moving plate 104 may rotate relative to the mounting plate 102 around an axis 105 when force is applied, such as through a tremolo arm 106 (e.g., a lever arm) or by other means. It is understood that the tremolo arm 106 is not limited to that shown and may, for example, be of many different shapes and have differing numbers and angles of curves. The moving plate 104 forms the base for a tremolo mechanism that includes bridge clamps 108 and tuning plates 110 that are used to secure and tune strings of the musical instrument. The moving plate 104, when forced via the arm 106, rotates around the axis 105, thereby increasing or decreasing the tension on the strings depending on the direction of rotation. FIG. 1A illustrates the moving plate 104 in a first position relative to the mounting plate 102.

Figure 1B:
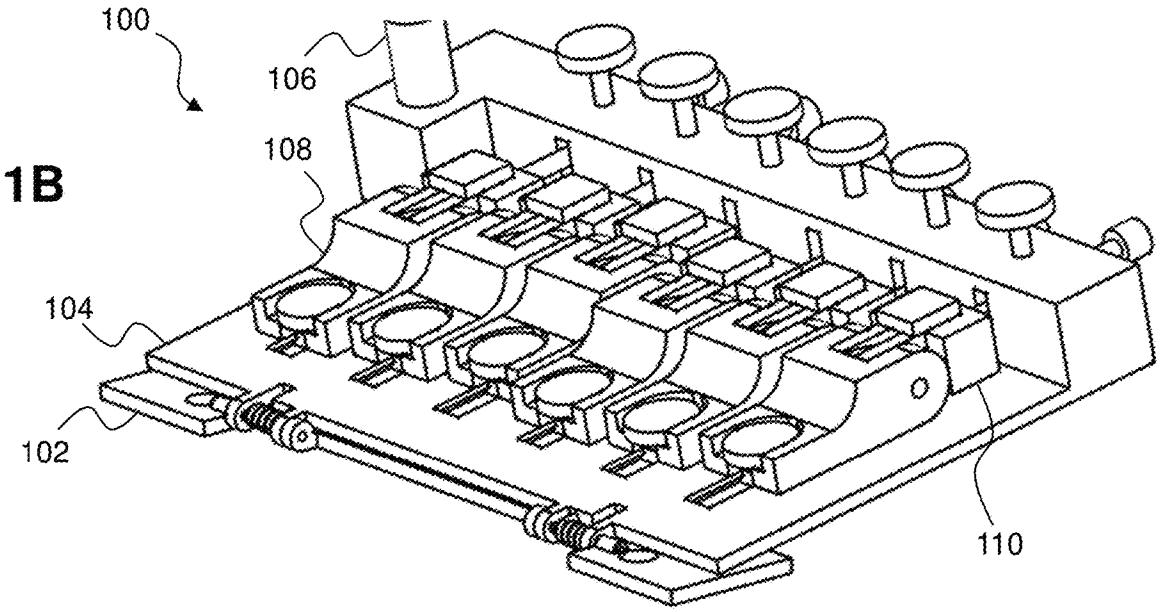
Figure 1C:
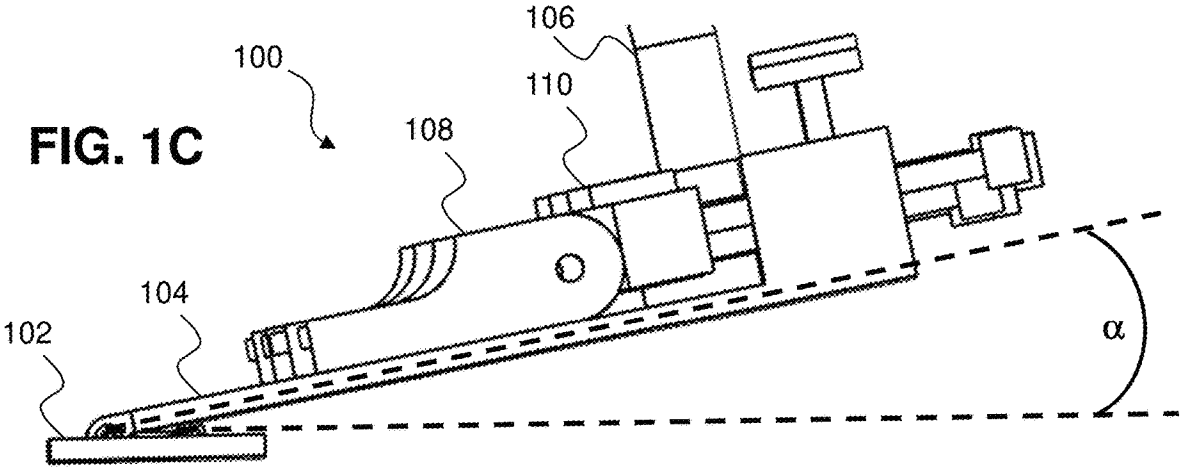

With additional reference to FIGS. 1B and 1C, the moving plate 104 is illustrated in a second position relative to the mounting plate 102 following rotation of the moving plate 104 around the axis 105. An angle of rotation $\alpha$ may vary based on settings applied to the tremolo apparatus 100 and/or based on the particular design of the mounting plate 102, the moving plate 104, and/or other components. For example, a stop may be integrated into or provided for the tremolo apparatus 100 to limit the available rotational range. It is understood that the use of first and second positions is for purposes of example and there may be multiple rotational positions.

Figure 1D:
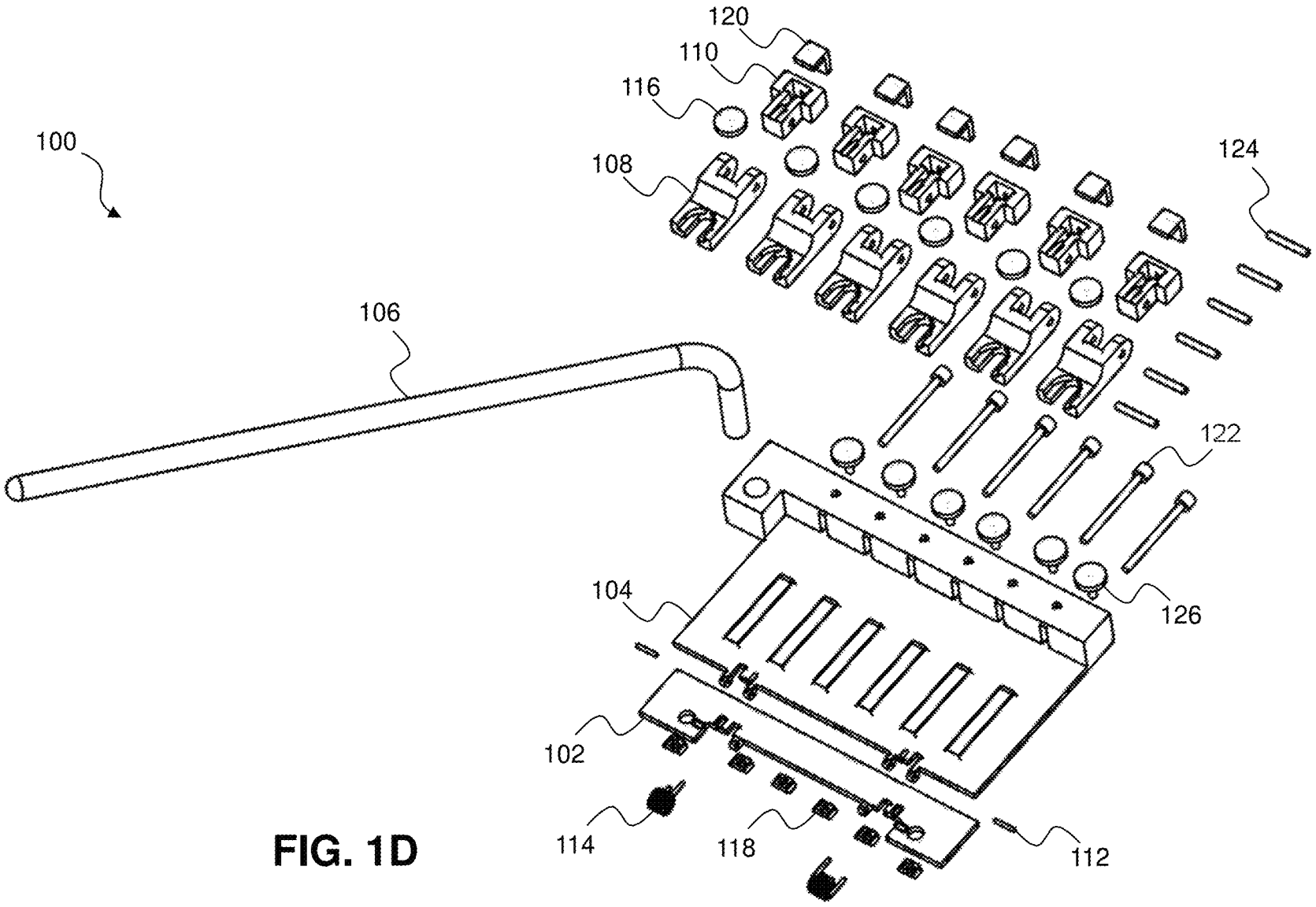
Figure 1E:
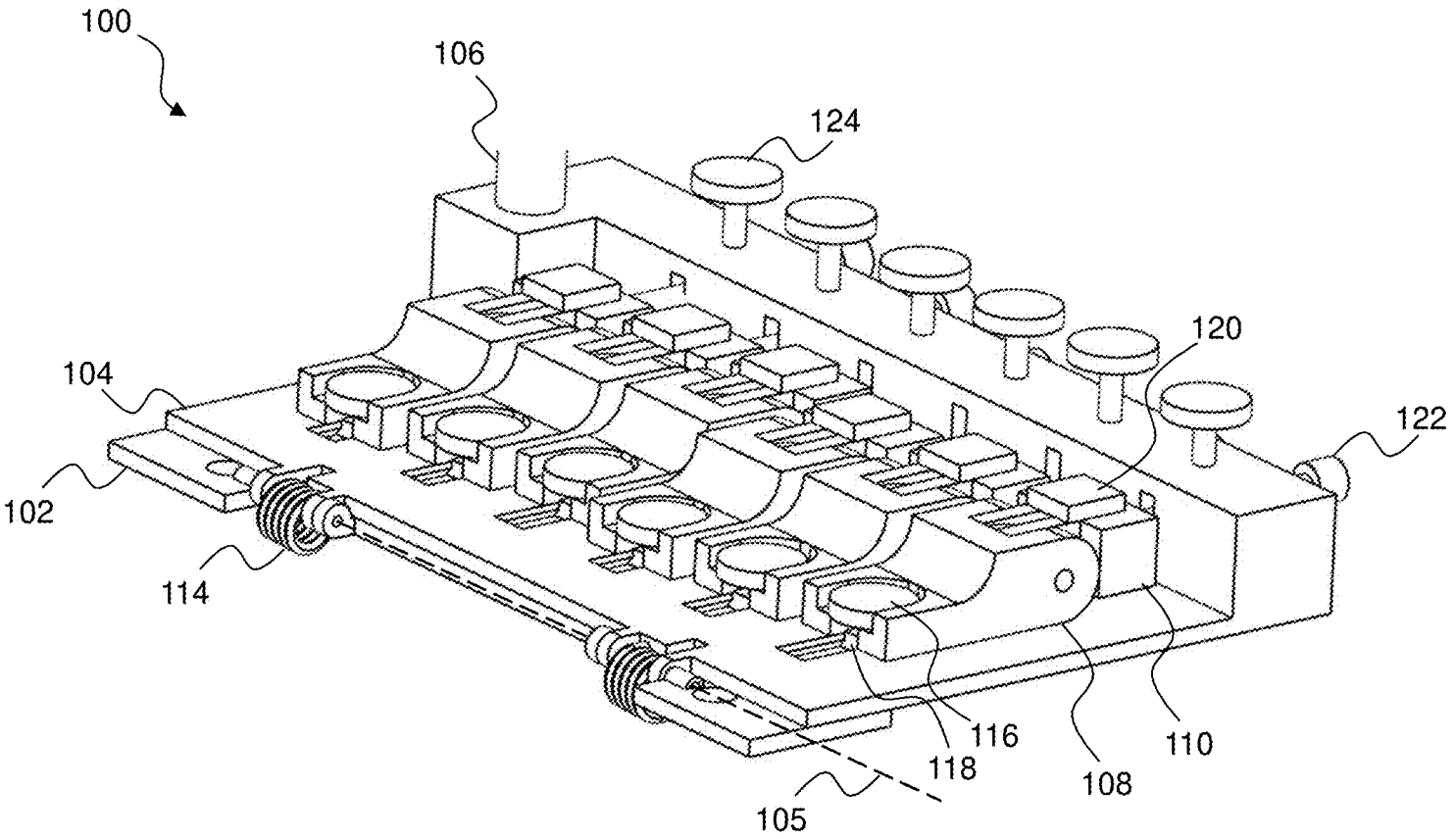
Figure 1F:
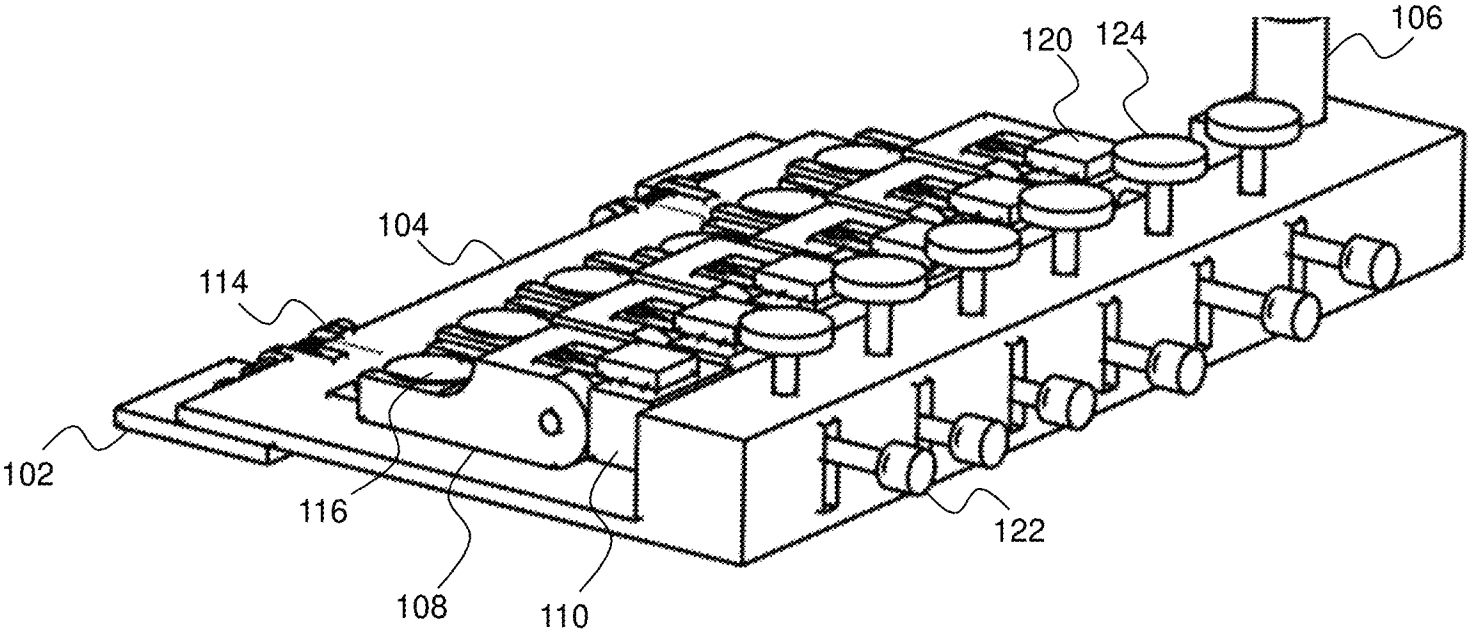

With additional reference to FIG. 1D, the tremolo apparatus 100 is shown in an exploded view with one or more pins 112 that couple the moving plate 104 to the mounting plate 102. One or more torsion devices (e.g., springs) 114 may be used to apply torsional force around the axis of rotation 105. The springs 114 may be used to bias the mounting plate 102 and the moving plate 104 towards or away from each other. It is understood that springs are used for purposes of example and that many different torsion devices may be used in addition to, or instead of, the illustrated springs.

Bridge clamp screws 116 and bridge clamp nuts 118 may be used to secure the bridge clamps 108 to the moving plate 104. The tuning plates 110, which may be rotatably coupled to their respective bridge clamps 108 via pins 124, are configured to receive string clamps 120 that are secured via string clamp screws 122. In some embodiments, the string clamp screws 122 may be used to fasten the string directly, in which case the string clamps 120 may be omitted. Fine tuning screws 126, which may be omitted in some embodiments, may be used to make finer adjustments to the pitch of the associated string as will be described below in greater detail.

It is understood that the screws described herein may be replaced by any other suitable fastener, and may be in various forms (e.g., thumbscrews intended for manipulation via fingers and/or various screwhead configurations intended for manipulation via tools). Furthermore, it is understood that some openings may be replaced by a threaded screw or a similar mechanism that is to be engaged by a nut or another fastener.

Figure 2:
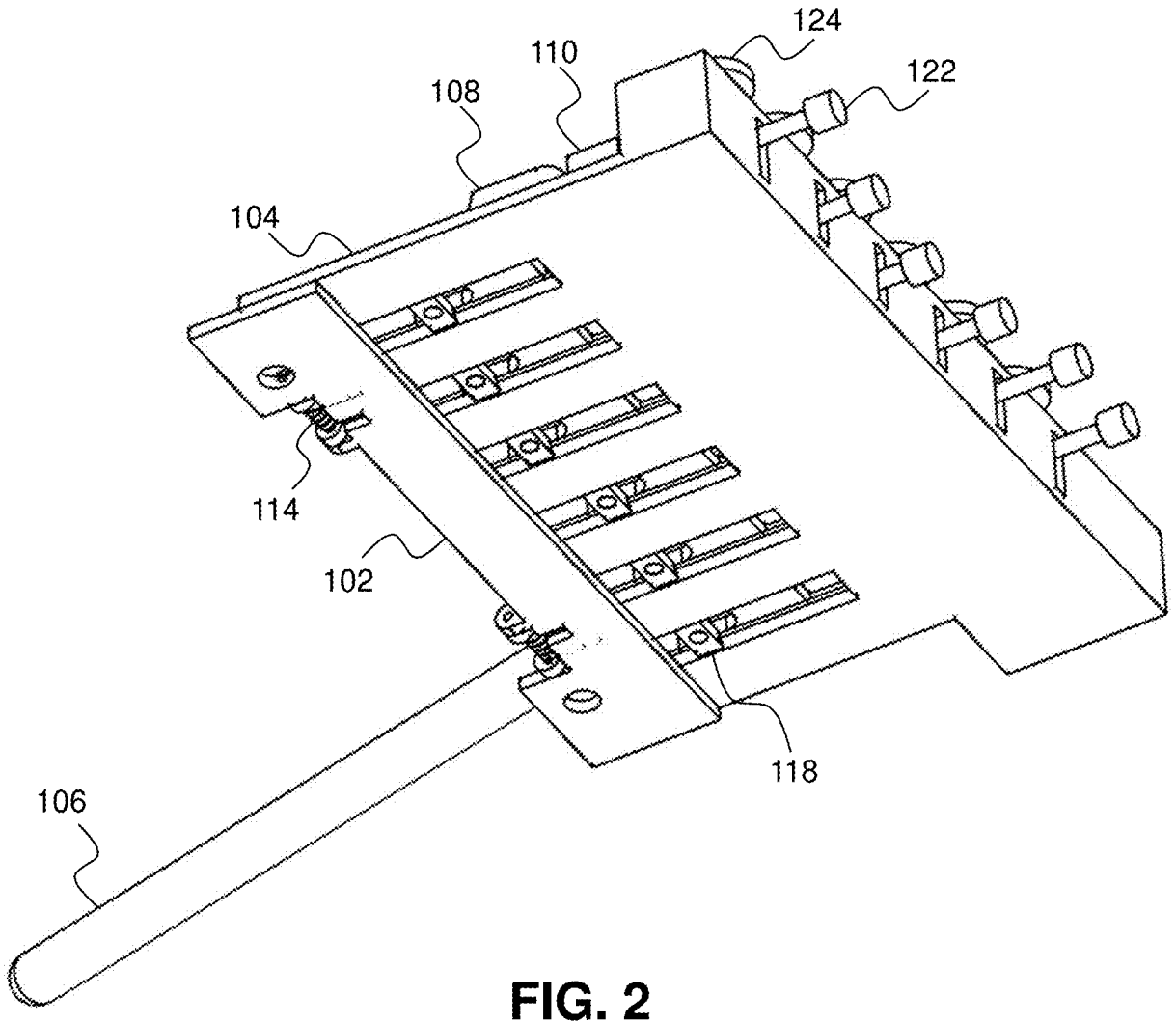
FIG. 2 illustrates one embodiment of the tremolo apparatus of FIGS. 1A-1F from the underside.

Referring to FIG. 2, one embodiment of the tremolo apparatus of FIGS. 1A-1F is illustrated from the underside.

Figure 3:
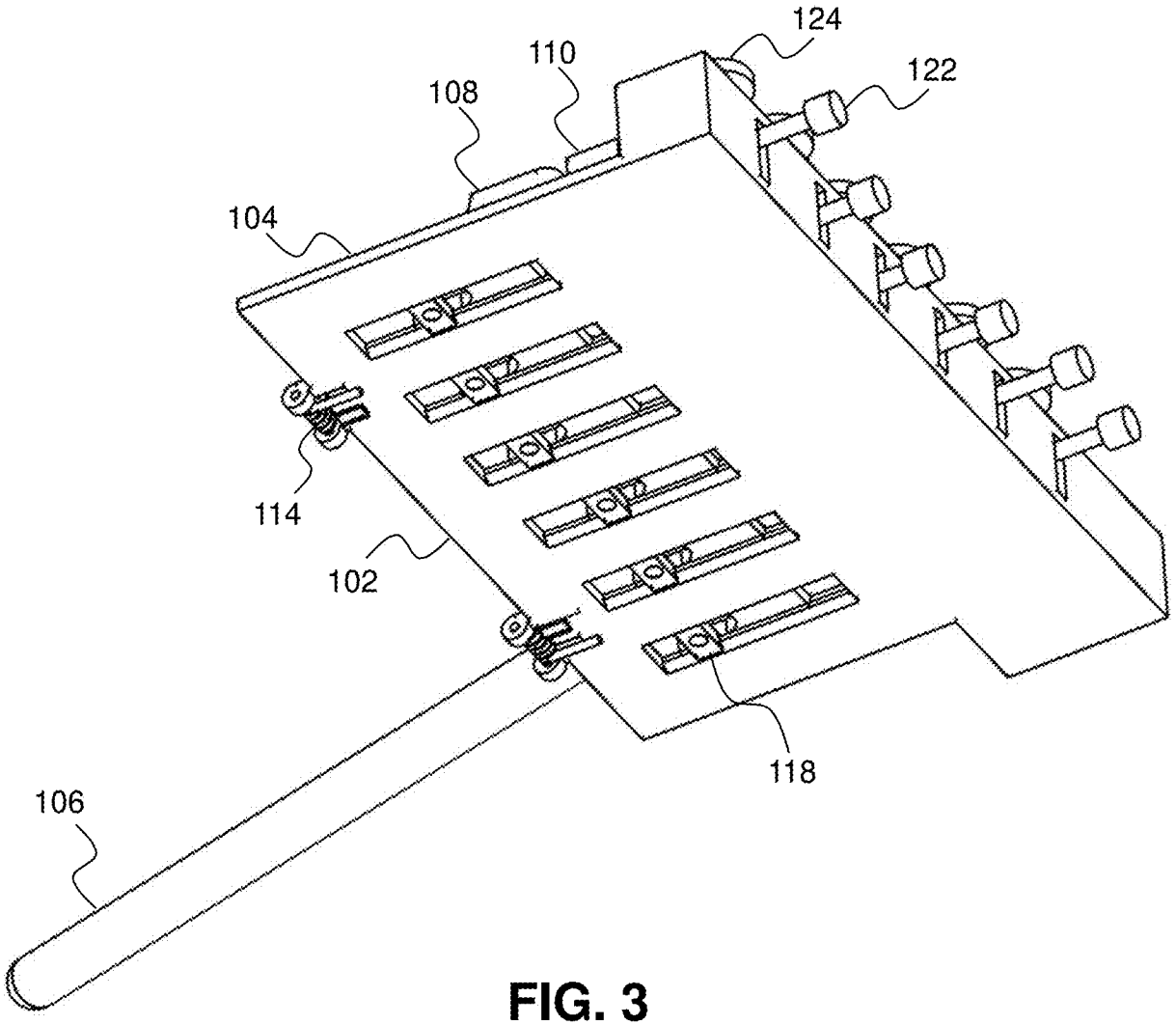
FIG. 3 illustrates one embodiment of the tremolo apparatus of FIG. 2 with the mounting plate removed.

Referring to FIG. 3, the tremolo apparatus 100 of FIG. 2 is illustrated with the mounting plate 104 omitted.

Figure 4:
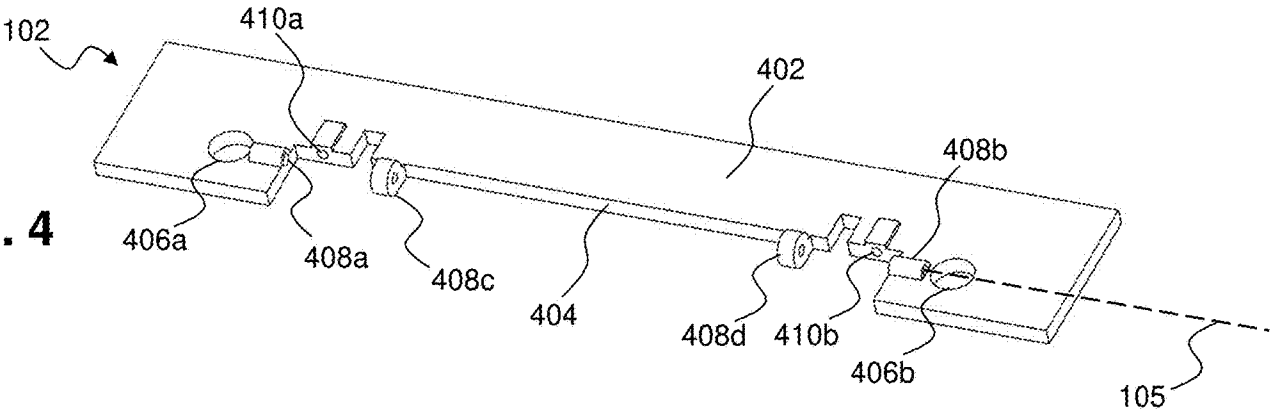
FIG. 4 illustrates one embodiment of a mounting plate.

Referring to FIG. 4, one embodiment of the mounting plate 102 is illustrated in greater detail with a substantially planar upper surface 402 and a front edge 404. The mounting plate 102 includes mounting holes 406*a* and 406*b* that may be used to attach the mounting plate 102 to a musical instrument.

It is understood that the location and number of mounting holes may vary depending on the particular instrument onto which the tremolo apparatus 100 is to be mounted. Accordingly, by varying the number and location of the holes 406, the tremolo apparatus 100 may be configured for various instruments. In other embodiments, the mounting plate 102 may be provided as multiple plates that are individually mounted to the musical instrument. In addition, it is understood that various spacers or other features may be integrated into or otherwise used with the mounting plate 102.

Pin mounts 408*a*-408*d* are provided to receive mounting pins 112 (FIG. 1D). It is understood that alternate pin arrangements (e.g., fewer or more pins) may require modifications to the pin mounts. Accordingly, while the current embodiment illustrates one way in which to couple the mounting plate 102 to the moving plate 104 in a manner that allows relative rotation around the axis 105, many other coupling configurations may exist and are contemplated in the scope of the present disclosure.

Spring mounts 410*a* and 410*b* may be provided to engage springs 114. Although shown as openings (e.g., holes) in the front edge 404, it is understood that the spring mounts 410*a* and 410*b* may be implemented in many different ways.

Figure 5A:
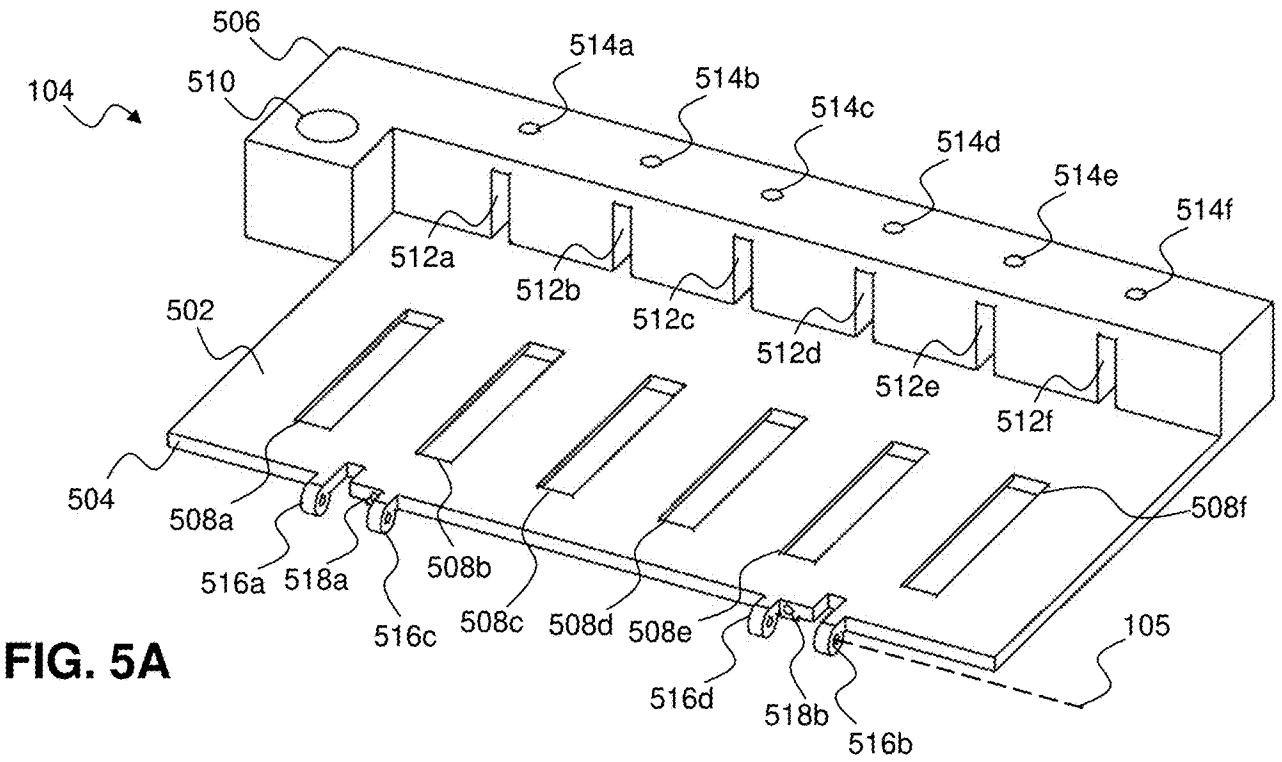
FIGS. 5A-5C illustrate various views of one embodiment of a moving plate.
Figure 5B:
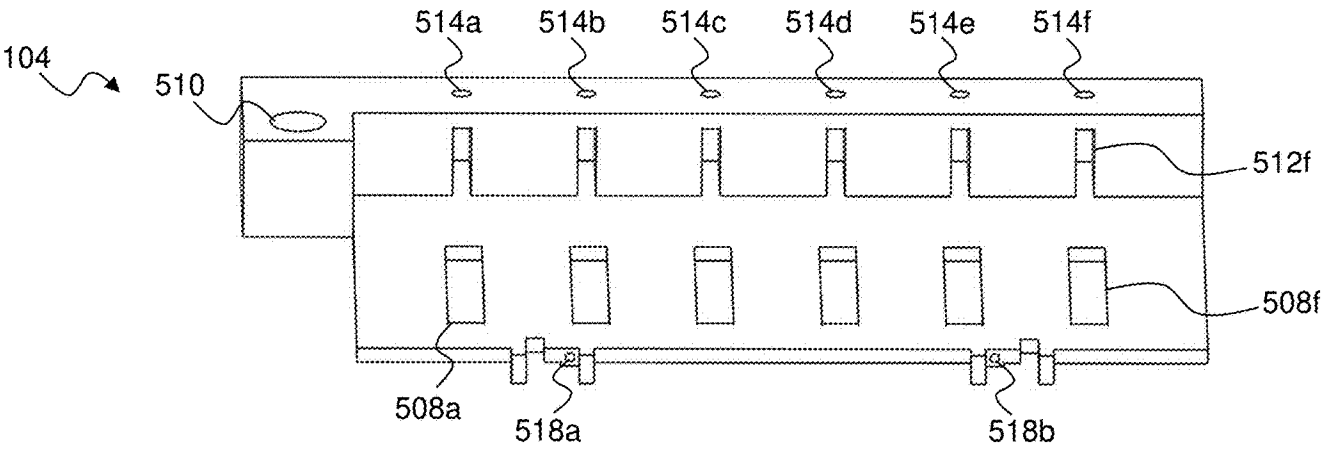
Figure 5C:
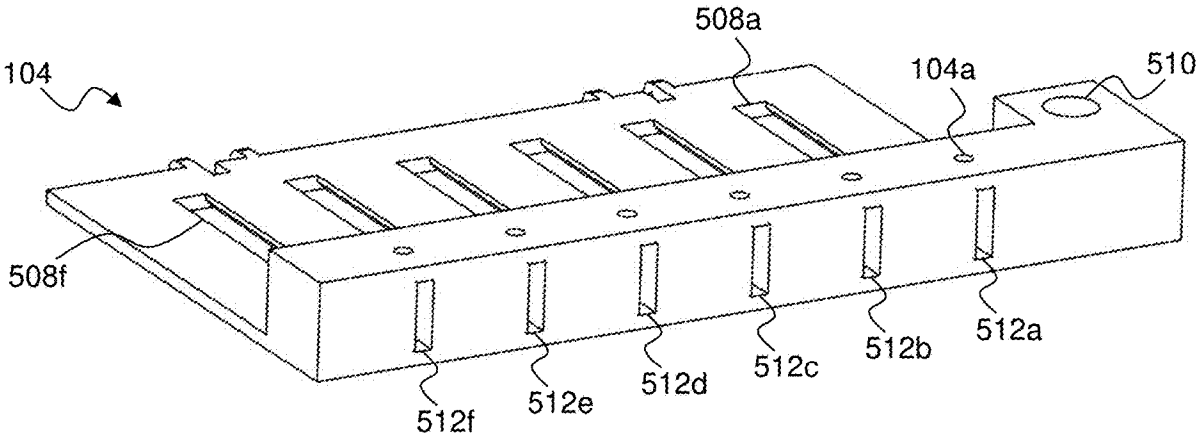

Referring to FIGS. 5A-5C, one embodiment of the moving plate 104 is illustrated in greater detail with an upper surface 502 and a front edge 504. In the present example, the moving plate 104 includes the substantially planar upper surface 502 and a riser section 506 that rises above the planar portion. Openings (e.g., slots) 508*a*-508*f* extend perpendicularly to the axis 105 along the upper surface 502.

The bridge clamp screws 116 pass through the slots 508*a*-508*f* to engage the bridge clamp nuts 118 in order to secure the bridge clamps 108 to the moving plate 104. The use of slots 508*a*-508*f* enables the bridge clamps 108 to be moved closer to or farther from the front edge 504 as needed. It is understood that while shown as slots, holes or other shaped openings may be used in some embodiments. In still other embodiments, the bridge clamps 108 may be immovably attached to the moving plate 104.

The riser section 506 includes an opening 510 for the arm 106. Openings (e.g., slots) 512*a*-512*f* allow the string clamp screws 122 to pass through the riser section 506 to secure string clamps 120. If present, additional openings 514*a*-514*f* may be provided to allow the fine tuning screws 126 to pass through the riser section 506 to engage the string clamp screws 122. The openings may be threaded to engage threads of the fine tuning screws 126.

Pin mounts 516*a*-516*d* are provided to receive mounting pins 112 (FIG. 1D). It is understood that alternate pin arrangements (e.g., fewer or more pins) may require modifications to the pin mounts. Accordingly, while the current embodiment illustrates one way in which to couple the mounting plate 102 to the moving plate 104 in a manner that allows relative rotation around the axis 105, many other coupling configurations may exist and are contemplated within the scope of the present disclosure.

Spring mounts 518*a* and 518*b* may be provided to engage springs 114. Although shown as openings in the front edge 504, it is understood that the spring mounts 518*a* and 518*b* may be implemented in many different ways.

Figure 6:
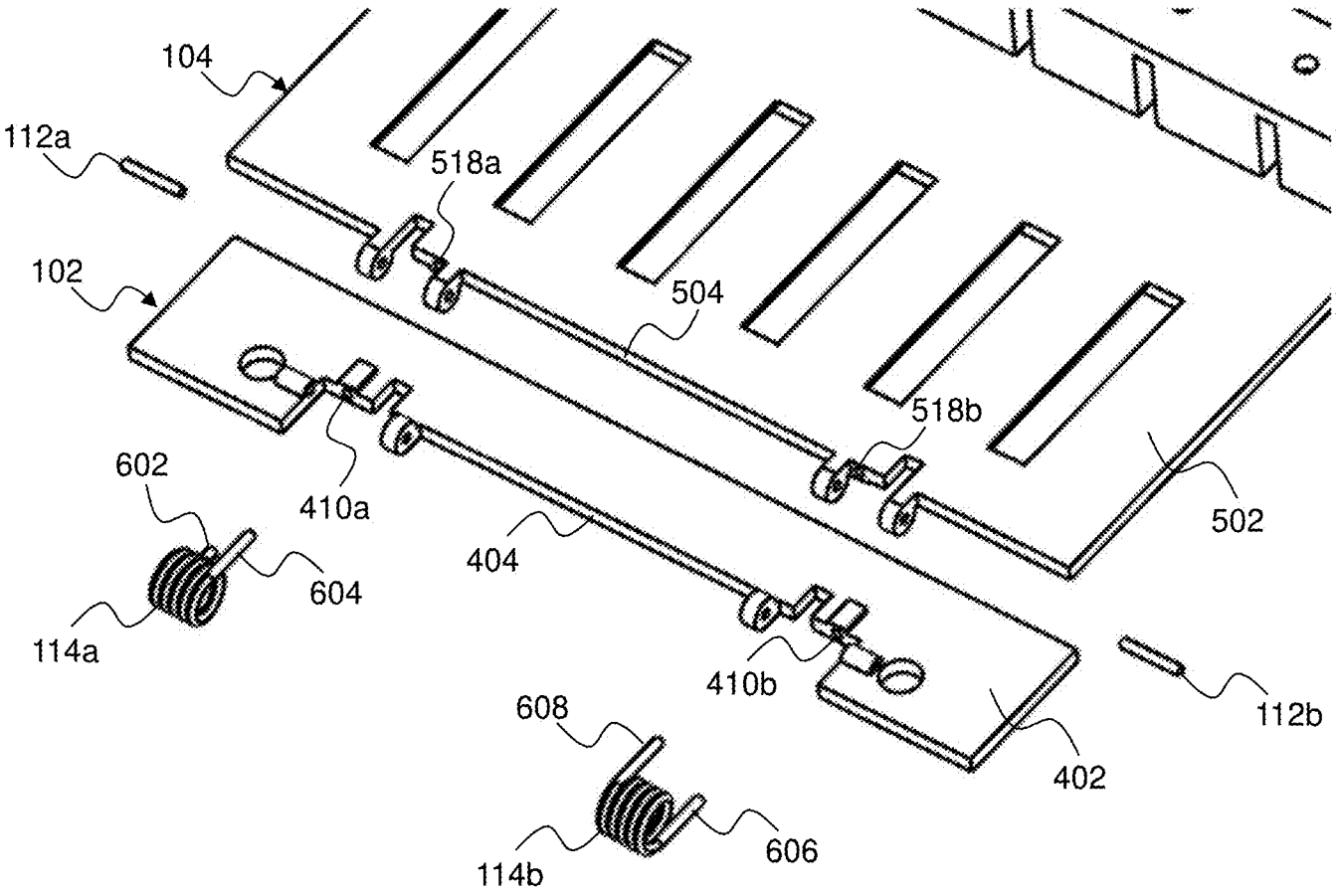
FIG. 6 illustrates an exploded view of embodiments of the mounting plate of FIG. 4 and a portion of the moving plate of FIGS. 5A-5C.
Figure 7:
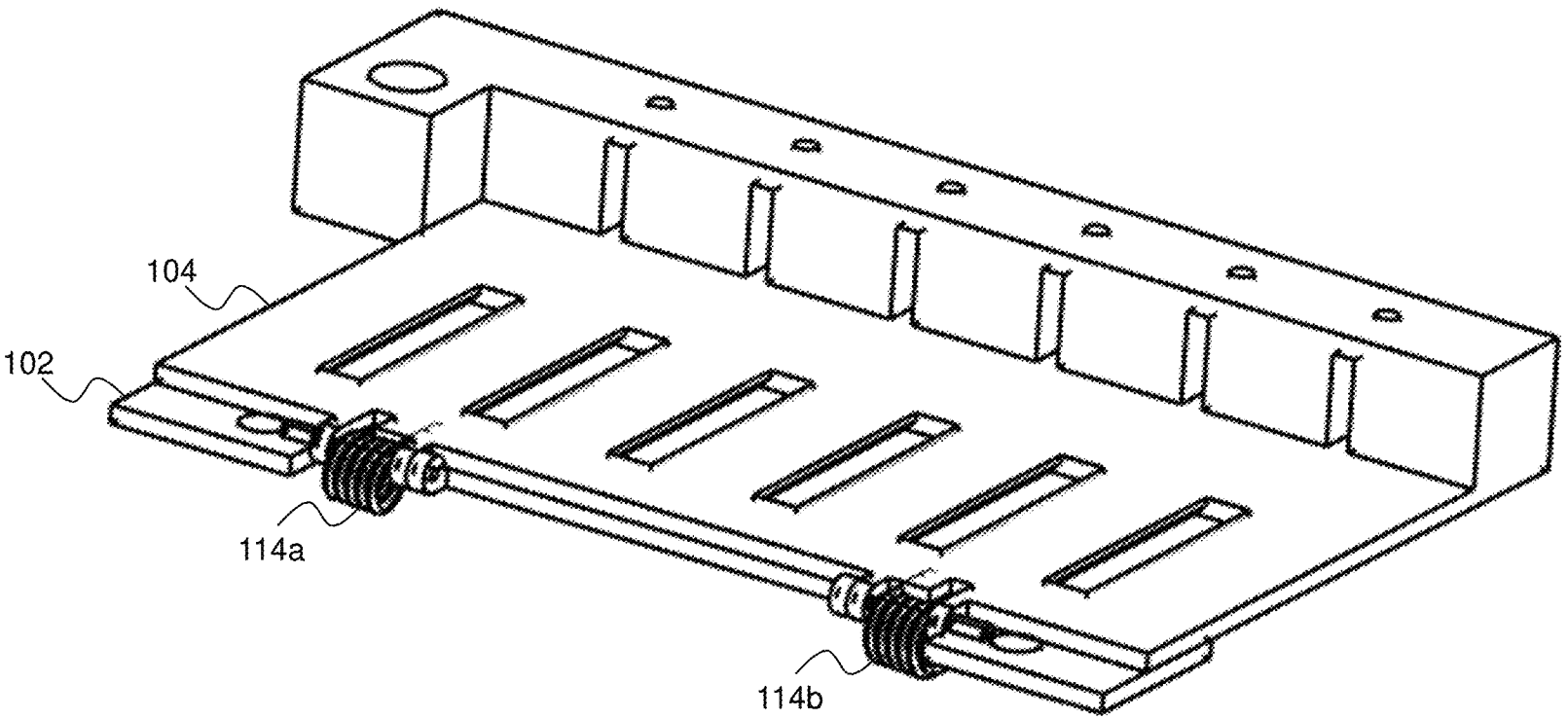
FIG. 7 illustrates the mounting plate and moving plate of FIG. 6 after being rotatably coupled.

Referring to FIGS. 6 and 7, one embodiment of the mounting plate 102 and moving plate 104 is illustrated in greater detail as separate components (FIG. 6) and in assembled form (FIG. 7). The torsion spring 114*a* has a first end 602 that engages (e.g., is inserted into) the spring mount 410*a* of the mounting plate 102, and a second end 604 that engages the spring mount 518*a* of the moving plate 104. Similarly, the torsion spring 114*b* has a first end 606 that engages (e.g., is inserted into) the spring mount 410*b* of the mounting plate 102, and a second end 608 that engages the spring mount 518*b* of the moving plate 104. Pins 112*a* and 112*b* slide through the springs 114*a* and 114*b* and into the pin mounts to couple the mounting plate 102 to the moving plate 104.

Figure 8:
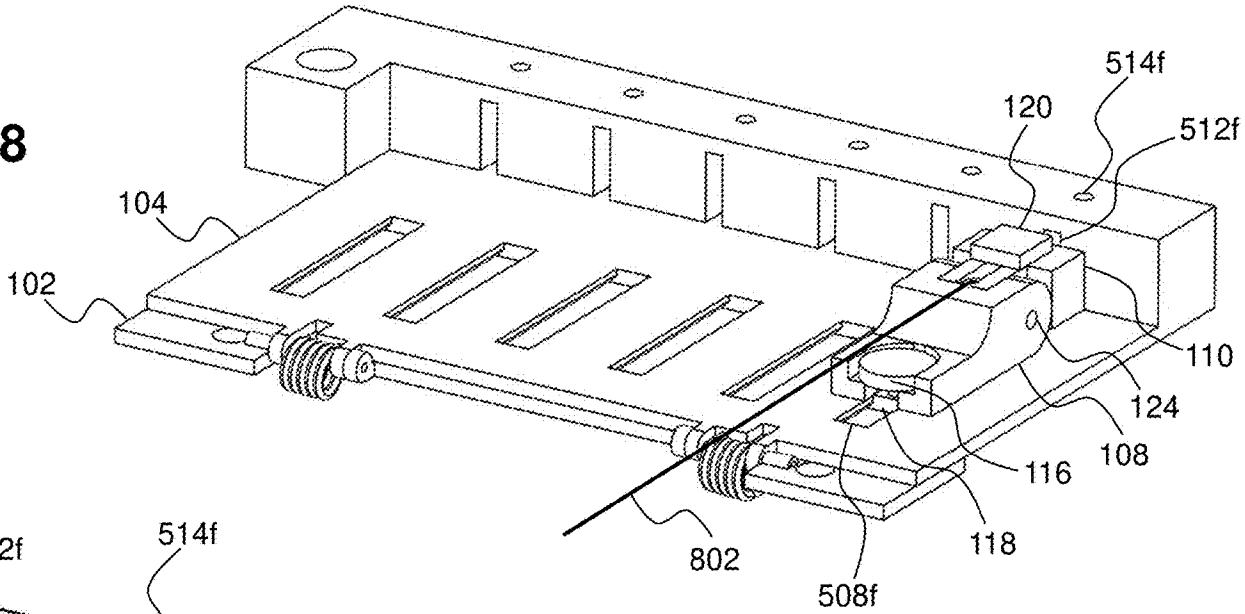
FIG. 8 illustrates the coupled mounting plate and moving plate of FIG. 7 with a bridge clamp, a tuning plate, and other components with a single musical instrument string.

Referring to FIG. 8, one embodiment of the assembled form of FIG. 7 is illustrated with a bridge clamp 108 coupled to the moving plate 104 by a bridge clamp screw 116 and a bridge clamp nut 118. In the present example, the bridge clamp 108 is positioned at the slot 508*f* (FIG. 5A) and is associated with a guitar sting 802. The bridge clamp 108 is secured to the moving plate 104 and is not movable unless the bridge clamp screw is loosened to allow the bridge clamp 108 to slide along the slot 508*f*. When in the desired position, the bridge clamp 108 is locked into place using the bridge clamp screw 116 and bridge clamp nut 118, as the bridge clamp 108 is not intended to move relative to the moving plate 104 after the guitar string 802 is secured.

A tuning plate 110 is rotatably coupled to the bridge clamp 108 by a pin 124. As will be described below in greater detail, the tuning plate 110 includes a curved slope that receives the end of the guitar string 802. A string clamp 120 is used to lock the guitar string 802 into place. Also illustrated are an opening 512*f* for a string clamp screw 122 (not shown) and an opening 514*f* for a fine tuning screw 126 (not shown).

Figure 9:
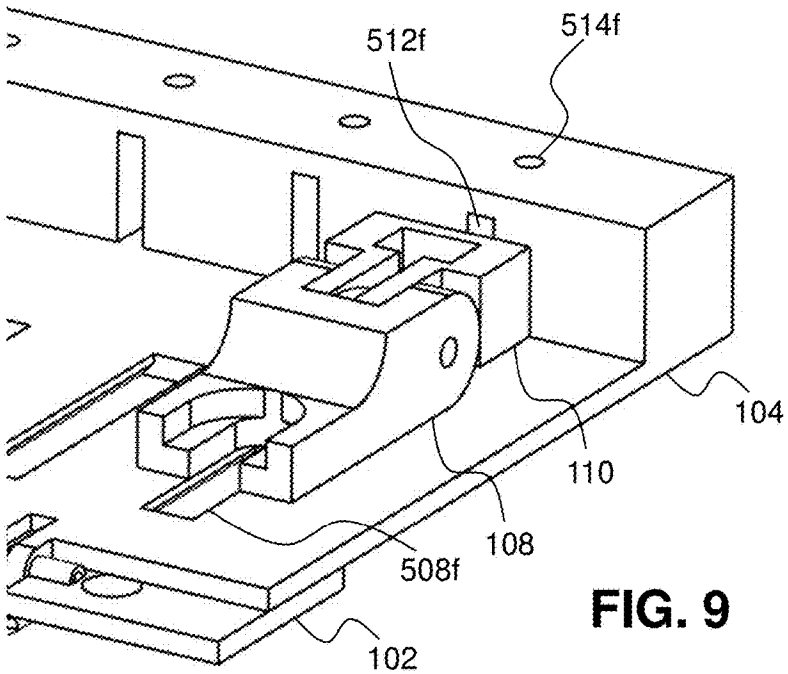
FIG. 9 illustrates a closer view of the coupled mounting plate and moving plate of FIG. 8 with the bridge clamp and tuning plate, but with some components omitted.

With additional reference to FIG. 9, the bridge clamp 108 and the tuning plate 110 of FIG. 8 are illustrated. The bridge clamp screw 116, bridge clamp nut 118, and string clamp 120 are omitted from the present figure. As shown, the bridge clamp 108 and/or the tuning plate 110 may include one or more arms or flanges that enable one or more pins 124 to rotatably couple the two components together.

Referring to FIGS. 10A-10D, the components of FIG. 8 are illustrated. Also present in some figures are a string clamp screw 122 (inserted into the opening 512*f* of FIG. 8) and a fine tuning screw 126 (inserted into the opening 514*f* of FIG. 8).

As shown, the body of the tuning plate 110 may not be in contact with the upper surface 502 of the moving plate 104. This enables the tuning plate 110 to rotate around an axis of rotation provided by the pin 124 (as indicated by arrows 1002*a* and 1002*b*) while the bridge clamp 108 remains stationary. The guitar string 802 is under tension (as indicated by arrow 1008) and, since it is locked into the tuning plate 110, it exerts pressure to rotate the tuning plate 110 in the direction of the arrow 1002*a*.

The string clamp screw 122 moves perpendicularly with respect to the back of the tuning plate 110 (as indicated by arrow 1004). The string clamp screw 122 may also move along the angle of rotation 1002*a*, 1002*b* due to movement of the tuning plate 110 to which it is coupled.

The fine tuning screw 126 moves vertically (as indicated by arrow 1006) with respect to the upper surface 502 of the moving plate 104 and engages the string clamp screw 122. By regulating the vertical movement of the string clamp screw 122, the fine tuning screw 126 operates to counteract the rotational bias imparted by the guitar spring 802. This enables the fine tuning screw 126 to be used to make minor adjustments to the angle of the tuning plate 110, and therefore to the tension of the guitar string 802.

Figure 10A:
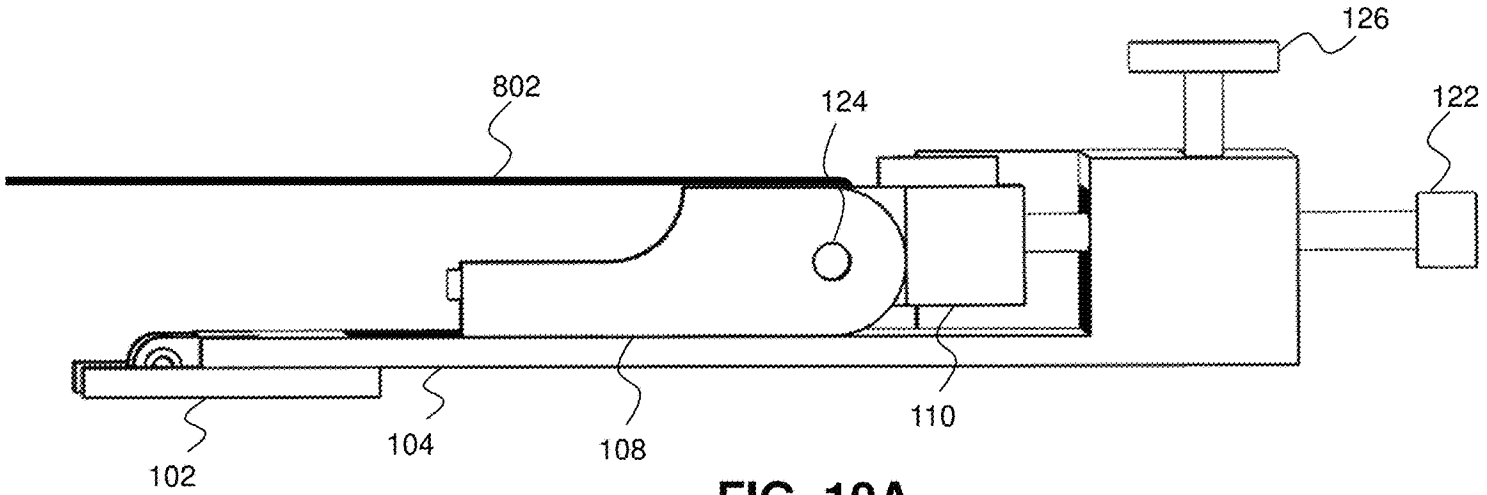
FIGS. 10A-10D illustrate side views (FIGS. 10A, 10B) and perspective views (FIGS. 10C, 10D) of a bridge clamp, a tuning plate, and other components with a single musical instrument string.
Figure 10B:
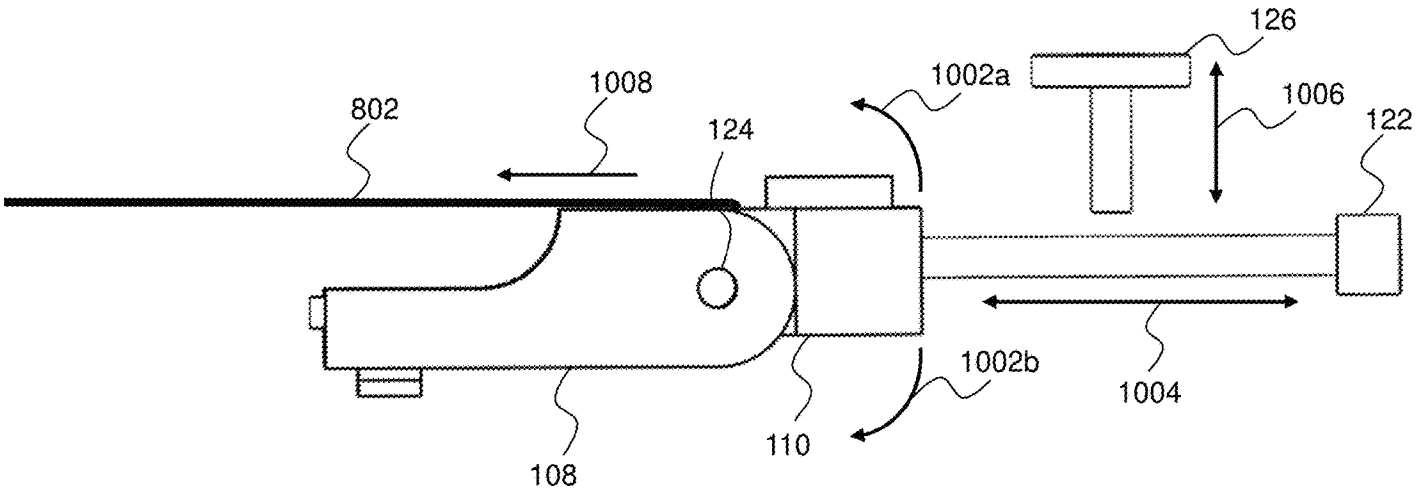
Figure 10C:
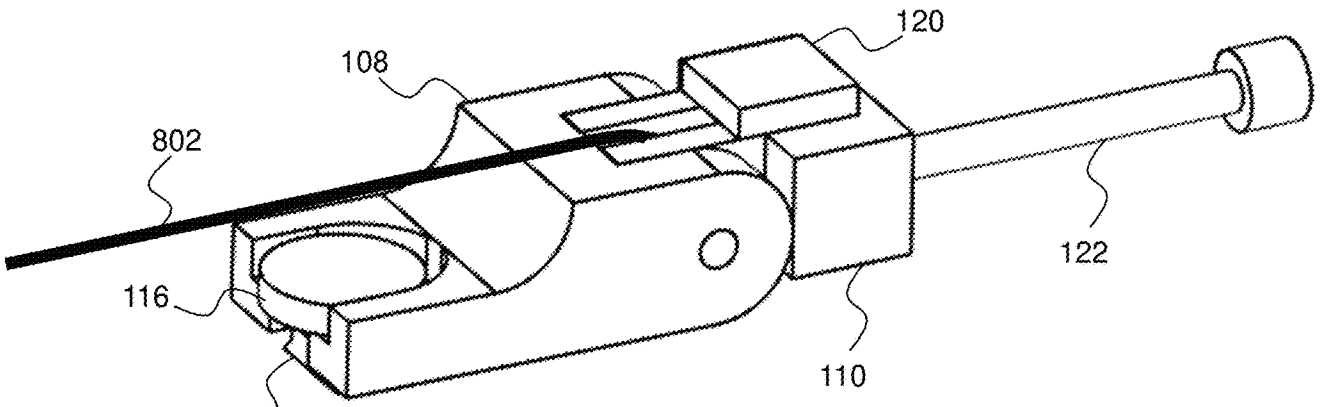
Figure 10D:
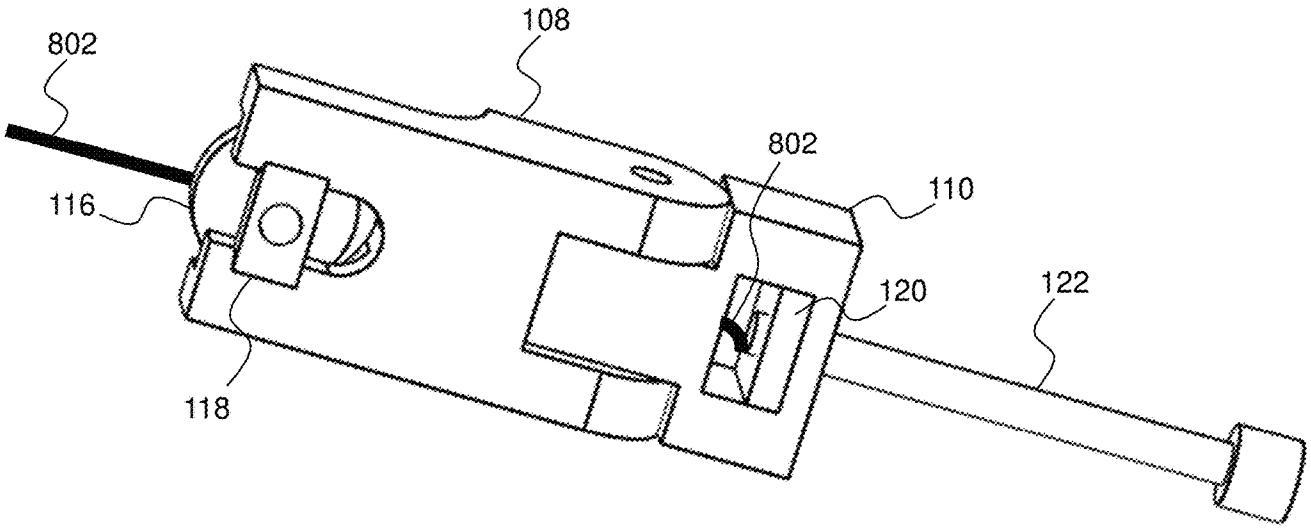

For purposes of illustration, the string clamp 120 in FIG. 10D is not shown in its fully forward position in order to show one end of the guitar string 802. Actuation of the string clamp screw 122 may move the string clamp 120 forward (e.g., towards the bridge clamp 108), thereby securing the guitar string 802 in the tuning plate 110.

Figure 12:
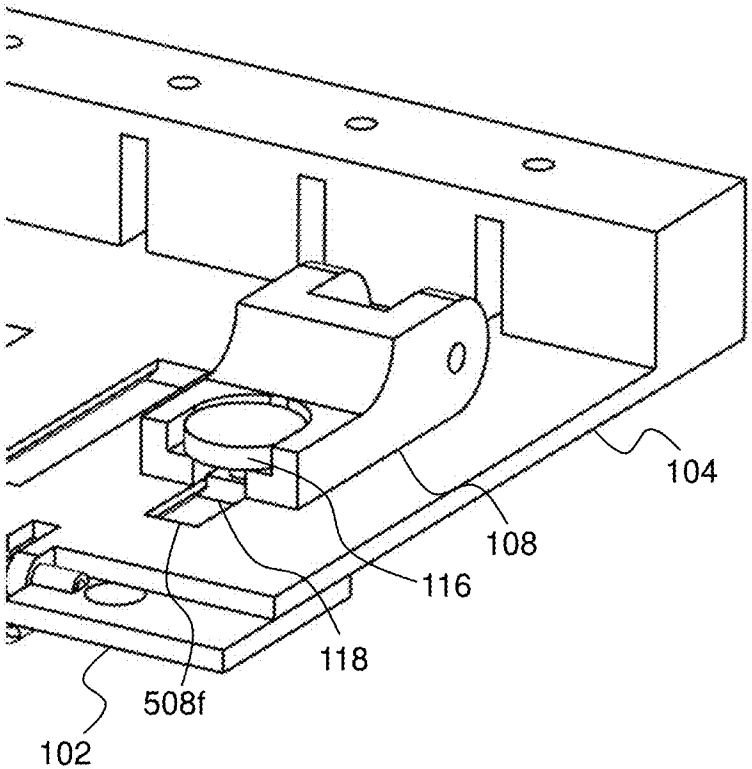
FIG. 12 illustrates the coupled mounting plate and moving plate of FIG. 11 with the addition of a bridge clamp screw.
Figure 11:
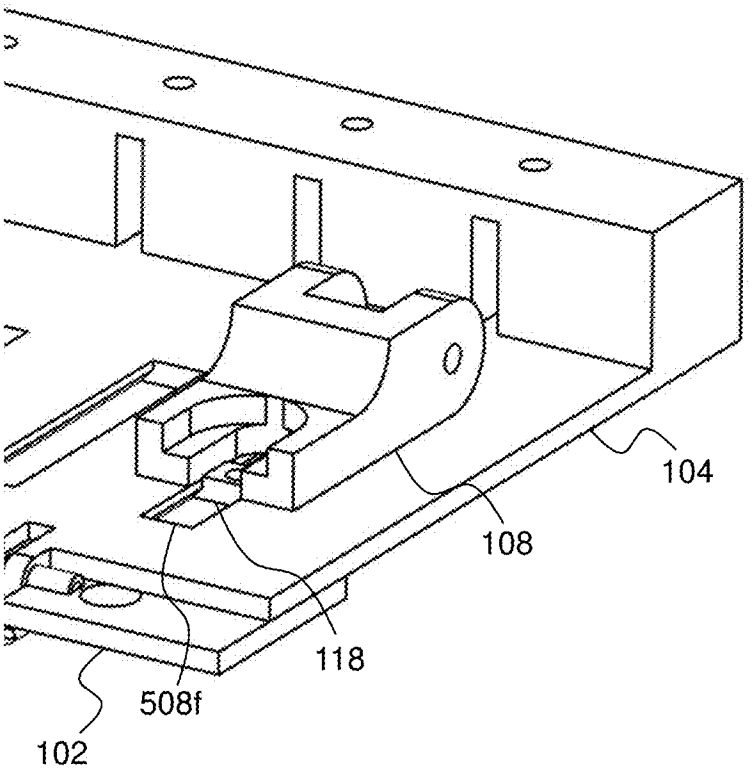
FIG. 11 illustrates the coupled mounting plate and moving plate of FIG. 9 with the bridge clamp and a bridge clamp nut.

Referring to FIGS. 11 and 12, one embodiment of the bridge clamp 108 of FIGS. 8 and 9 is illustrated with the bridge clamp nut 118, both without the bridge clamp screw 116 (FIG. 11) and with the bridge clamp screw 116 (FIG. 12).

Figure 13A:
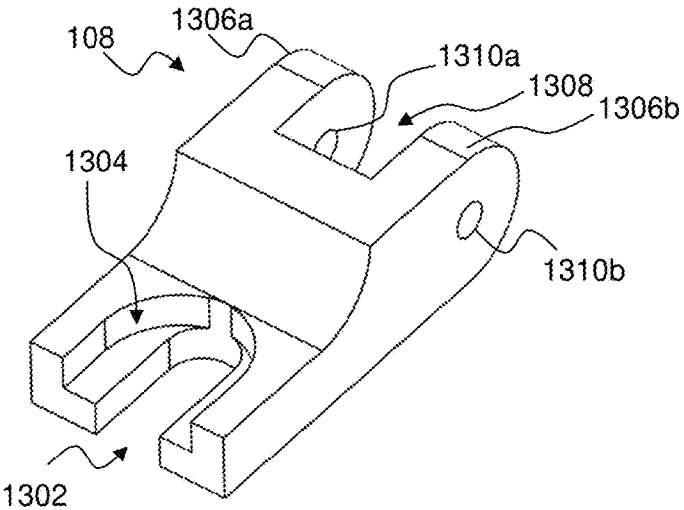
FIGS. 13A and 13B illustrate one embodiment of a bridge clamp.
Figure 13B:
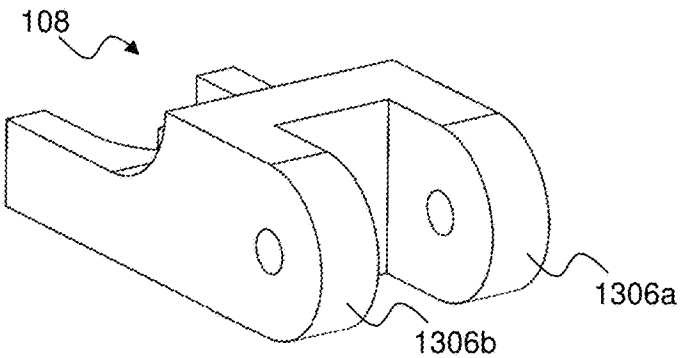

With additional reference to FIGS. 13A and 13B, one embodiment of the bridge clamp 108 is illustrated. The bridge clamp 108 includes an opening 1302 (e.g., a slot) through which the bridge clamp screw 116 may pass to engage the bridge clamp nut 118. An indentation 1304 may be provided to enable the head of the bridge clamp screw 118 to sit relatively flush with the surrounding surface of the bridge clamp 108.

The bridge clamp 108 further includes one or more arms 1306*a*, 1306*b*. In the present example, a gap 1308 exists between the arms 1306*a*, 1306*b* to receive the arm(s) of the tuning plate 110. Each arm 1306*a*, 1306*b* includes an opening 1310*a*, 1310*b*, respectively, to receive the pin 124 that couples the bridge clamp 108 to the tuning plate 110.

As shown, the surfaces of the arms 1306*a*, 1306*b* facing towards the tuning plate 110 may be curved or otherwise shaped to enable the tuning plate 110 to rotate relative to the bridge clamp 108. In other embodiments, the tuning plate 110 may be shaped to allow such rotation in addition to or instead of the bridge clamp 108.

Figure 14:
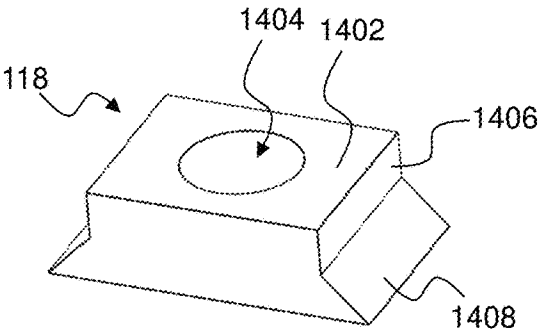
FIG. 14 illustrates one embodiment of a bridge clamp nut.

Referring to FIG. 14, one embodiment of a bridge clamp nut 118 is illustrated. In this example, the bridge clamp nut 118 includes an upper surface 1402 that faces the bridge clamp screw 116 and includes an opening to receive the bridge clamp screw 116. One or more edges may be shaped (e.g., beveled) to engage the corresponding opening in the moving plate 104. As shown, the portion 1406 near the upper surface 1402 is vertical, while the lower portion 1408 of the edge is sloped outward.

Figure 15:
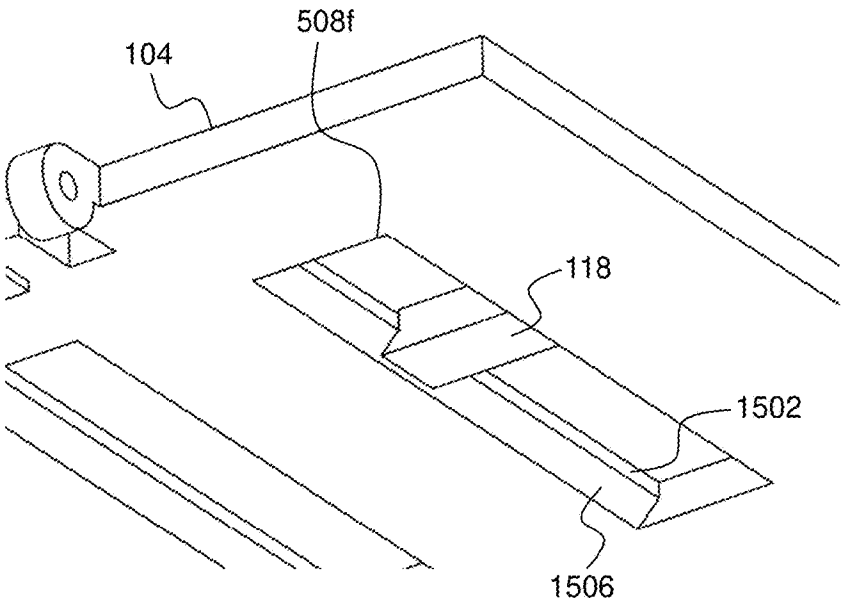
FIG. 15 illustrates a view of one embodiment of the underside of the moving plate with the bridge clamp nut of FIG. 14.

With additional reference to FIG. 15, the bridge clamp nut 118 of FIG. 14 is illustrated positioned within the slot 508*f* of the moving plate 104. The slot 508*f* includes an edge with portions 1502, 1504 that are shaped to engage the portions 1406, 1408 of the bridge clamp nut 118. For example, the portion 1502 is vertical and the portion 1504 is sloped to engage the slope 1408 and prevent further vertical movement of the bridge clamp nut 118. This shaping enables the bridge clamp nut 118 to move along the slot 508*f* if the bridge clamp 108 is moved, while not protruding from the bottom side of the moving plate 104 and not able to exit the top side of the slot 508*f* when engaged by the bridge clamp screw 116.

Figure 17:
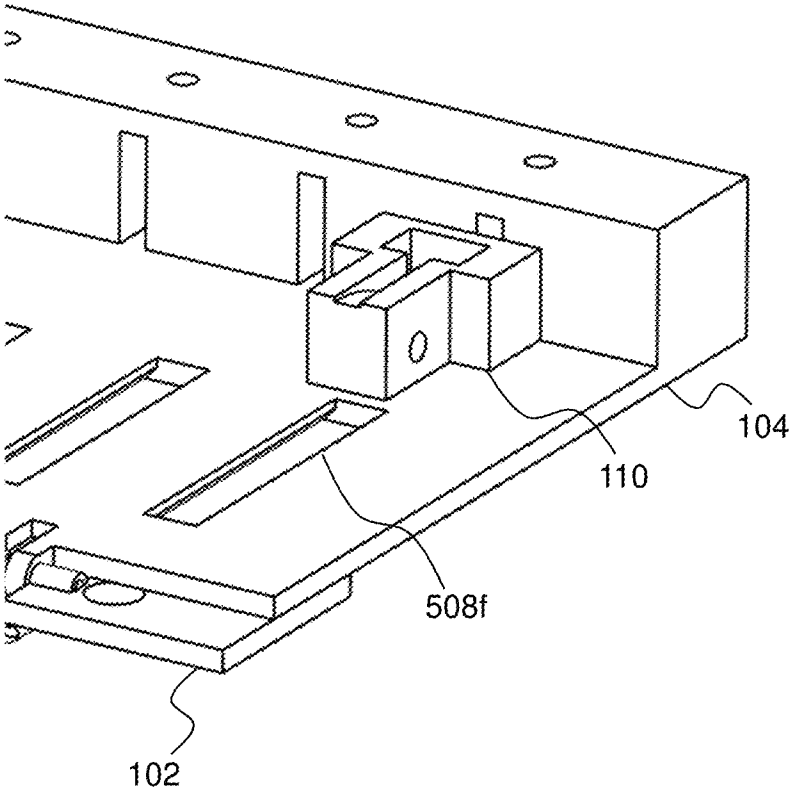
FIG. 17 illustrates the coupled mounting plate and moving plate of FIG. 15 with the string clamp removed.
Figure 16:
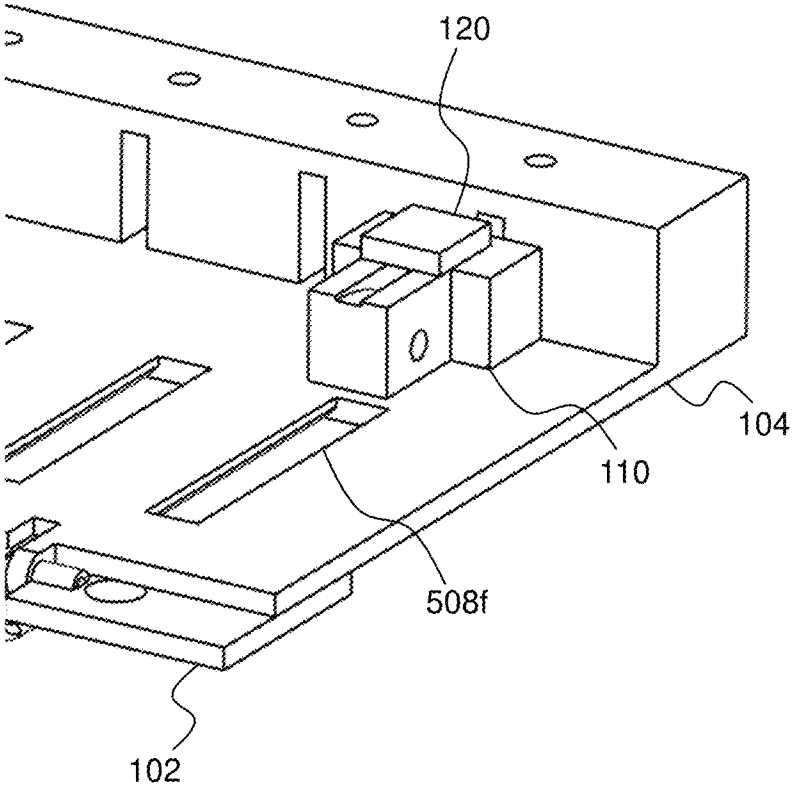
FIG. 16 illustrates the coupled mounting plate and moving plate of FIG. 9 with the tuning plate and a string clamp.

Referring to FIGS. 16 and 17, one embodiment of the tuning plate 110 of FIGS. 8 and 9 is illustrated with the string clamp 120 (FIG. 16) and without the string clamp 20 (FIG. 17).

Figure 18B:
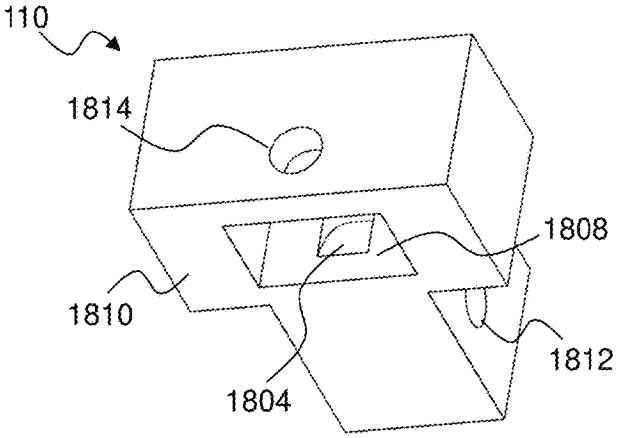
FIGS. 18A-18C illustrate various views of one embodiment of a tuning plate.
Figure 18A:
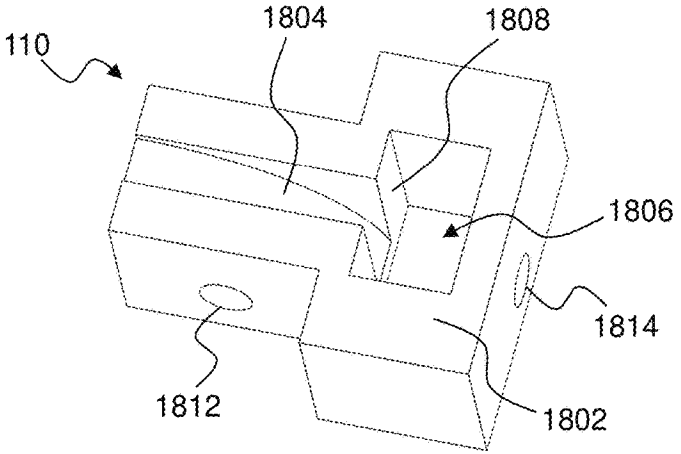
Figure 18C:
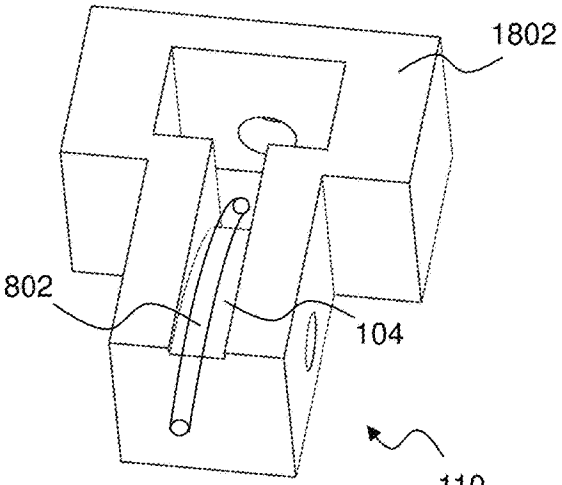

With additional reference to FIGS. 18A-18C, one embodiment of the tuning plate 110 is illustrated. In the present example, the tuning plate 110 is T-shaped when viewed from the top, with an upper surface 1802. The leg of the T, which is inserted between the arms of the bridge clamp 108, includes a sloped or curved surface 1804 that receives the guitar string 802. The sloped surface 1804 extends from the upper surface 1802 and intersects an opening 1806 that receives the string clamp 120. The sloped surface 1804 may form a groove or opening in an inner wall 1808 of the upper portion of the T.

The opening 1806 may extend all the way to a lower surface 1810. An opening 1812 is provided to receive the pin 124 that couples the tuning plate 110 to the bridge clamp 108. A threaded opening 1814 engages threads of the string clamp screw 122 as the string clamp screw 122 passes through the wall of the tuning plate 110 to press against the string clamp 120. The string clamp screw 122 may be tightened to move the string clamp 120 towards the inner wall 1808, thereby securing the guitar string 802.

Figure 19A:
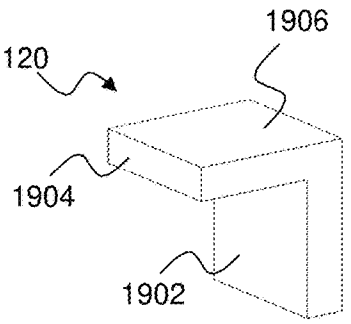
FIGS. 19A-19C illustrate embodiments of a string clamp.

Referring to FIG. 19A, one embodiment of a string clamp 120 is illustrated. In this example, the string clamp 120 has an upside down L-shape when viewed from the side, with the vertical leg of the L extending into the opening 1806 of the tuning plate 110. In this orientation, an inner surface 1902 of the vertical leg will face the sloped surface 1804 of the tuning plate 108. In some embodiments, the inner surface 1902 may be sloped similarly to the sloped surface 1804.

Figure 19B:
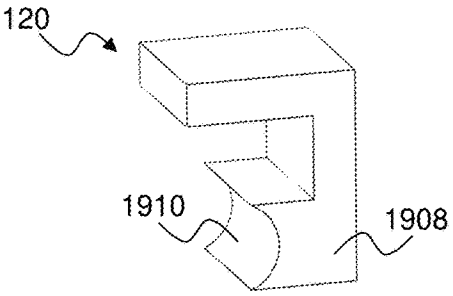
Figure 19C:
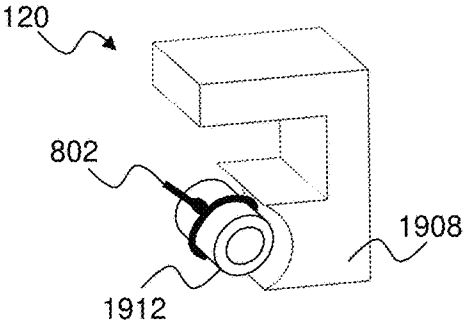

With additional reference to FIGS. 19B and 19C, another embodiment of a string clamp 120 is illustrated, in this example, the upper portion is similar to that of FIG. 19A, but the lower portion includes an extension 1908. The extension 1908 may include a curved surface 1910 suitable for receiving a ball end (e.g., a bead) 1912 of a musical instrument string 802. It is understood that the string clamp 120 may be used to secure the string 802 with or without a bead.

Figure 20:
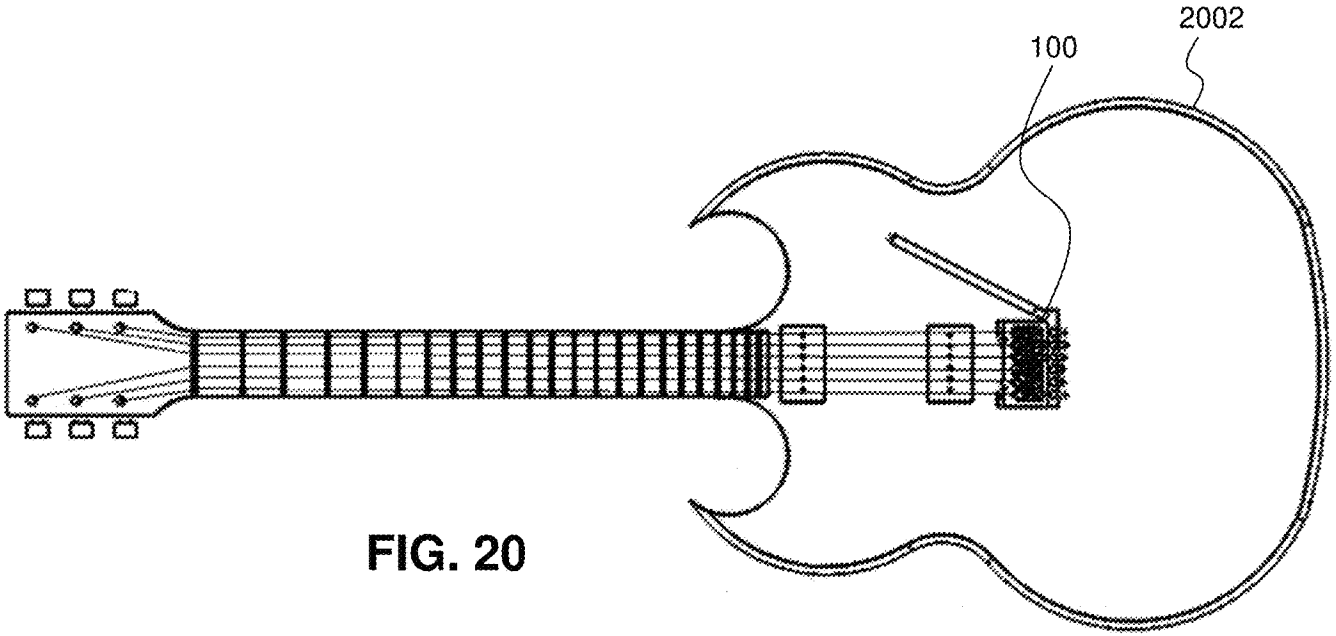
FIG. 20 illustrates one embodiment of a tremolo apparatus mounted on a guitar.

Referring to FIG. 20, one embodiment of the tremolo apparatus 100 is illustrated as mounted on a guitar 2002.

Any advantages and benefits described may not apply to all embodiments of the invention. When the word "means" is recited in a claim element, Applicant intends for the claim element to fall under 35 USC 112(f). Often a label of one or more words precedes the word "means". The word or words preceding the word "means" is a label intended to ease referencing of claims elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC 112(f).

The foregoing description of the embodiments of the invention has been presented for the purposes of illustration and description. It is not intended to be exhaustive or to limit the invention to the precise form disclosed. Many combinations, modifications and variations are possible in light of the above teaching. For instance, in certain embodiments, each of the above described components and features may be individually or sequentially combined with other components or features and still be within the scope of the present invention. Undescribed embodiments which have interchanged components are still within the scope of the present invention. It is intended that the scope of the invention be limited not by this detailed description, but rather by the claims.

What is claimed is:

1. A tremolo apparatus for a string musical instrument comprising:

a moving plate configured to rotate around an axis of rotation relative to a surface of a musical instrument;

at least one bridge clamp coupled to the moving plate and horizontally adjustable relative to an upper surface of the moving plate; and a tuning plate rotatably coupled to the bridge clamp and vertically adjustable relative to the upper surface of the moving plate, wherein the bridge clamp and tuning plate secure an instrument string of the music instrument with a desired amount of string tension when the moving plate is in a first rotational position relative to the surface of the musical instrument.

2. The tremolo apparatus of claim 1 further comprising a mounting plate for attaching the tremolo apparatus to the musical instrument, wherein the moving plate is rotatably coupled to the mounting plate.

3. The tremolo apparatus of claim 2 wherein the mounting plate is configured to be mounted on the musical instrument without modification of the musical instrument.

4. The tremolo apparatus of claim 1 further comprising a torsion device positioned to impart torsional force on the moving plate relative to the surface of the musical instrument around the axis of rotation.

5. The apparatus of claim 4 wherein the torsion device is a torsion spring.

6. The tremolo apparatus of claim 1 further comprising a string clamp screw that engages the tuning plate to secure the instrument string to the tuning plate.

7. The tremolo apparatus of claim 6 further comprising a fine tuning screw that regulates vertical movement of the string clamp screw in order to adjust a rotational range of the tuning plate.

8. The tremolo apparatus of claim 6 further comprising a string clamp positioned within an opening in the tuning plate, wherein the string clamp is pressed against a wall of the tuning plate by the string clamp screw to secure the instrument string.

9. The tremolo apparatus of claim 1 further comprising a tremolo arm coupled to the moving plate, wherein application of force to the tremolo arm will result in rotation of the moving plate relative to the surface of the musical instrument to modify the tension of the instrument string.

10. A tremolo apparatus for a string musical instrument comprising:

a moving plate configured to rotate relative to a surface of a musical instrument around an axis of rotation;

a tuning assembly coupled to the moving plate and configured to secure an instrument string with a desired amount of string tension when the moving plate is in a first rotational position relative to the surface of the musical instrument, wherein the tuning assembly enables at least one of vertical adjustment and horizontal adjustment of the instrument string relative to a surface of the moving plate; and a torsion device configured to impart torsional force on the moving plate around the axis of rotation.

11. The tremolo apparatus of claim 10 wherein the tuning assembly includes:

a bridge clamp configured to receive the instrument string; and a tuning plate corresponding to the bridge clamp, wherein the tuning plate is configured to secure the instrument string with the desired amount of string tension.

12. The tremolo apparatus of claim 11 wherein the moving plate includes a slot for the bridge clamp extending perpendicularly relative to the axis of rotation to enable the bridge clamp to be repositioned relative to the axis.

13. The tremolo apparatus of claim 11 wherein the tuning plate is rotatably coupled to the bridge clamp along an axis that is substantially parallel to the axis of rotation.

14. The tremolo apparatus of claim 10 further comprising a string clamp screw that is positioned to secure the instrument string to the tuning assembly.

15. The tremolo apparatus of claim 14 further comprising a fine tuning screw configured to regulate a vertical movement of the string clamp screw.

16. The apparatus of claim 10 wherein the torsion device is a torsion spring.

17. The tremolo apparatus of claim 10 further comprising a mounting plate for attaching the tremolo apparatus to the musical instrument without modification of the musical instrument, wherein the moving plate is rotatably coupled to the mounting plate.

18. A method for using a tremolo apparatus for a string musical instrument, the method comprising:

using a tuning assembly coupled to a moving plate to secure an instrument string of a musical instrument, wherein the moving plate is rotatably coupled to the musical instrument;

using the tuning assembly to adjust at least one of a horizontal position and a vertical position of the instrument string relative to the moving plate to provide a desired amount of string tension to the instrument string when the moving plate is in a first rotational position relative to the musical instrument; and applying a torsional force to modify the string tension by rotating the moving plate around the axis of rotation to a second rotational position.

19. The method of claim 18 wherein adjusting the horizontal position includes moving a bridge clamp of the tuning assembly horizontally relative to a surface of the moving plate.

20. The method of claim 18 wherein adjusting the vertical position includes moving a tuning plate of the tuning assembly vertically relative to a surface of the moving plate.

* * * * *